US007708219B2

(12) United States Patent
Potts

(10) Patent No.: US 7,708,219 B2
(45) **Date of Patent: *May 4, 2010**

(54) MINERAL BREAKER

(75) Inventor: Alan Potts, Somercotes (GB)

(73) Assignee: MMD Design & Consultancy Limited (GB)

( * ) Notice: Subject to any disclaimer, the term of this patent is extended or adjusted under 35 U.S.C. 154(b) by 404 days.

This patent is subject to a terminal disclaimer.

(21) Appl. No.: 11/691,869

(22) Filed: Mar. 27, 2007

(65) Prior Publication Data

US 2007/0246587 A1 Oct. 25, 2007

(30) Foreign Application Priority Data

Sep. 26, 2005 (GB) ..... PCT/GB2005/003689

(51) Int. Cl.
*B02C 13/02* (2006.01)

(52) U.S. Cl. ..... 241/158; 241/189.1; 241/236

(58) Field of Classification Search ..... 241/158, 241/187, 236, 189.1
See application file for complete search history.

(56) References Cited

U.S. PATENT DOCUMENTS

| | | | | | |
|---|---|---|---|---|---|
| 3,151,645 | A | * | 10/1964 | Hesse | 241/231 |
| 3,578,252 | A | * | 5/1971 | Brewer | 241/141 |
| 4,702,422 | A | * | 10/1987 | Chambers et al. | 241/46.06 |
| 4,799,627 | A | * | 1/1989 | Potts | 241/236 |
| 5,163,629 | A | * | 11/1992 | Raterman et al. | 241/236 |
| 5,215,265 | A | * | 6/1993 | Lodovico | 241/99 |
| 5,516,050 | A | * | 5/1996 | Yamamoto et al. | 241/167 |
| 5,562,255 | A | * | 10/1996 | Witko et al. | 241/158 |
| 6,439,486 | B1 | * | 8/2002 | Nitta et al. | 241/29 |

FOREIGN PATENT DOCUMENTS

| | | | |
|---|---|---|---|
| DE | 20208107 | U1 | 10/2002 |
| EP | 0167178 | A2 | 1/1986 |
| GB | 2056879 | A | 3/1981 |
| GB | 2088746 | A | 6/1982 |
| JP | 2004174393 | A1 | 6/2004 |
| WO | WO 0035585 | A1 | 6/2000 |
| WO | WO 2005/072877 | A1 | 8/2005 |

* cited by examiner

*Primary Examiner*—Bena Miller
(74) *Attorney, Agent, or Firm*—C. G. Mersereau; Nikolai & Mersereau, P.A.

(57) ABSTRACT

A mineral breaker 10 including a row of side-by-side breaker drum assemblies 30 having radially projecting breaker teeth 38. The row includes at least four breaker drum assemblies 30 arranged to define an inner pair DB of adjacent breaker drum assemblies **30*a* located in-between a pair of outer breaker drum assemblies. The inner pair of breaker drum assemblies 30*a* defines therebetween a mineral deposit region DM for receiving mineral in-flow. The breaker drum assemblies 30*a* of said inner pair DB of breaker drum assemblies being rotated in opposite directions such that, in use, breaker teeth 38 on each of said inner breaker drum assemblies 30*a* act upon mineral being deposited in said deposit region DM to cause agitation of the deposited mineral in-flow in order to encourage undersized mineral to pass therebetween whilst preventing oversized mineral passing therebetween. Each breaker drum assembly 30*a*** of said inner pair DB of breaker drum assemblies acting upon oversized mineral in the material in-flow to cause the oversized mineral to be moved outwardly towards a respective one of said outer breaker drum assemblies.

7 Claims, 14 Drawing Sheets

MINERAL BREAKER

The present invention relates to a mineral breaker having a plurality of side-by-side breaker drum assemblies.

The kind of mineral breaker with which the present invention is particularly concerned functions to break down mineral lumps by a snapping action; see for example the mineral breaker described in our European patent no. 0 167 178 and our PCT patent application no. PCT/GB2004/004665.

This type of mineral breaker includes a pair of breaker drum assemblies, each of which includes a plurality of axially spaced annuli having on them circumferentially spaced breaker teeth. The annuli on one of the breaker drum assemblies are axially off-set from the annuli on the other of the breaker drum assemblies such that the breaker teeth of one annulus on one of the breaker drum assemblies pass in-between breaker teeth on a pair of neighbouring annuli on the other of the breaker drum assemblies.

With this type of mineral breaker, the breaker teeth interact to restrict the passageway in-between the breaker drum assemblies such that oversized lumps of mineral are prevented from passing therethrough.

Typically infill material being deposited onto the mineral breaker will contain a high proportion of fines and undersized lumps of mineral. Passage of this undersized mineral between the breaker drum assemblies affects the handling capacity of the mineral breaker (i.e. rate per hour of deposit of material into/through the mineral breaker).

Ideally, the lateral spacing between the adjacent breaker drum assemblies should be sufficiently narrow to restrict the passage of oversized lumps, but to facilitate rapid passage of undersized mineral therebetween.

In addition, the presence of oversized lumps is undesirable as they also act to restrict rapid passage of the undersized mineral through the mineral breaker.

A general object of the present invention is to provide a mineral breaker of the type described above, which has a high throughput capacity.

According to an aspect of the invention, there is provided a mineral breaker including a row of side-by-side breaker drum assemblies having radially projecting breaker teeth, the row including at least four breaker drum assemblies arranged to define an inner pair of adjacent breaker drum assemblies located in-between a pair of outer breaker drum assemblies, said inner pair of breaker drum assemblies defining therebetween a mineral deposit region for receiving mineral in-flow, the breaker drum assemblies of said inner pair of breaker drum assemblies being rotated in opposite directions such that, in use, breaker teeth on each of said inner breaker drum assemblies act upon mineral being deposited in said deposit region to cause agitation of the deposited mineral in-flow in order to encourage undersized mineral to pass therebetween whilst preventing oversized mineral passing therebetween, and each breaker drum assembly of said inner pair of breaker drum assemblies acting upon oversized mineral in the material in-flow to cause the oversized mineral to be moved outwardly towards a respective one of said outer breaker drum assemblies.

Embodiments of the present invention are hereinafter described, by way of non-limiting example, with reference to the accompanying drawings in which.

Figure 1:
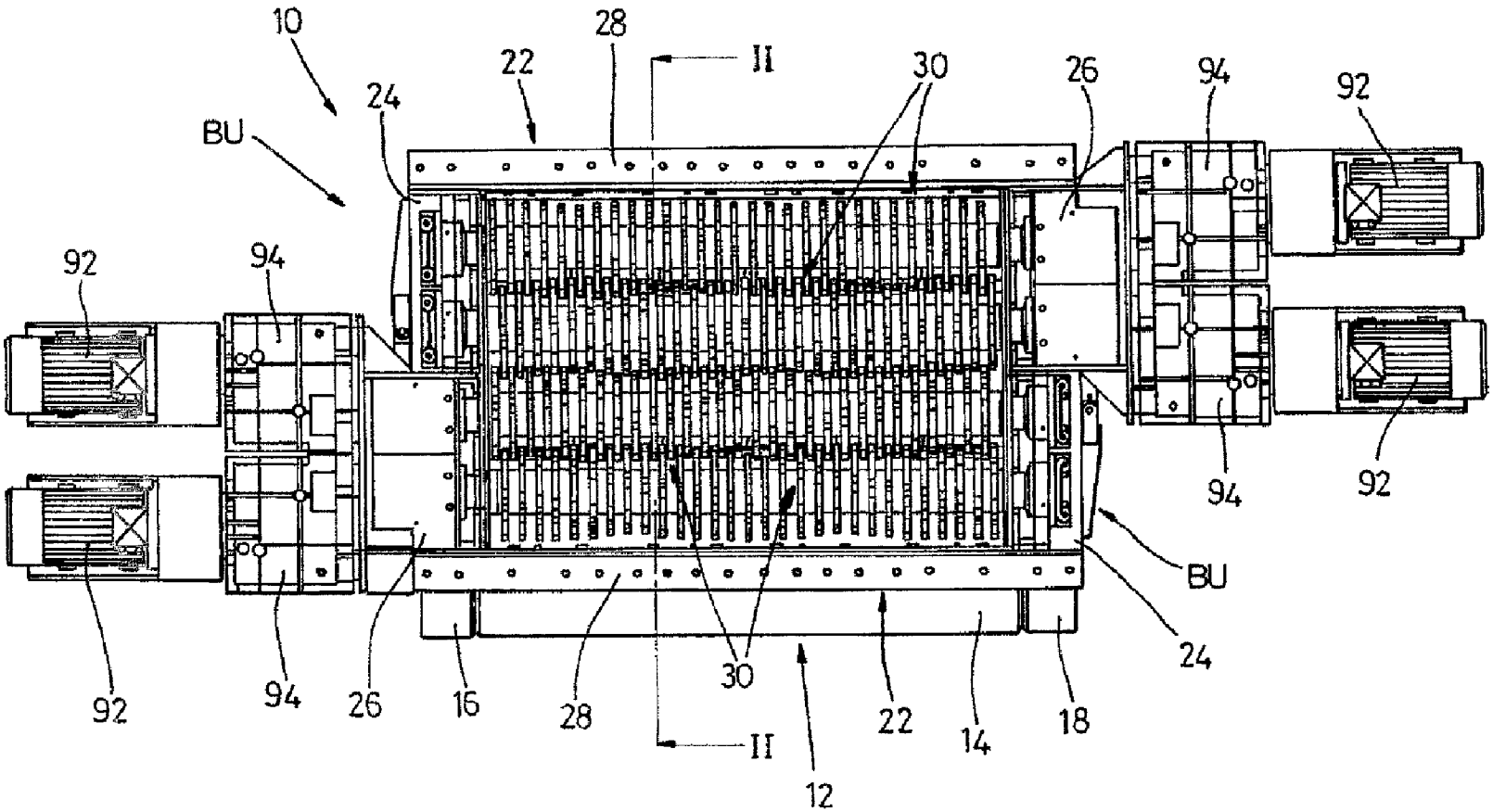
FIG. 1 is a plan view of a mineral breaker according to a first embodiment of the present invention.
Figure 2:
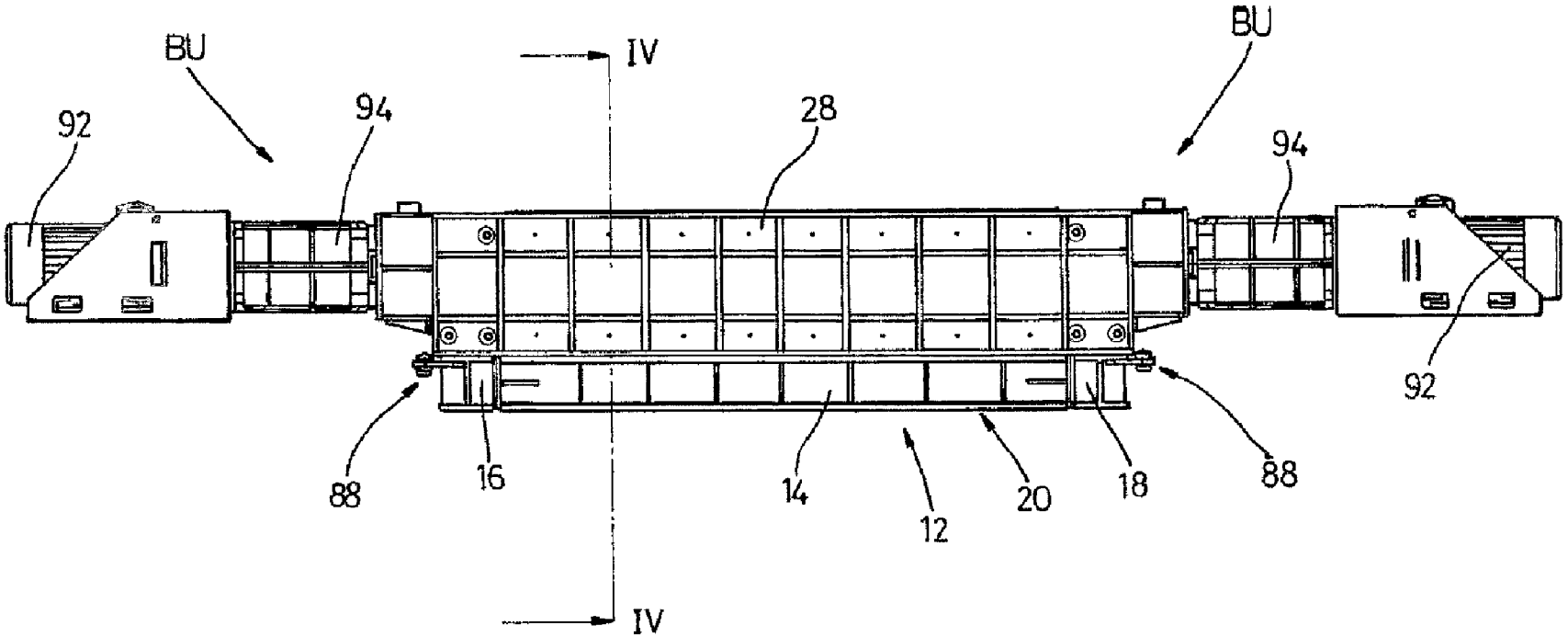
FIG. 2 is a side view of the mineral breaker shown in FIG. 1.
Figure 3:
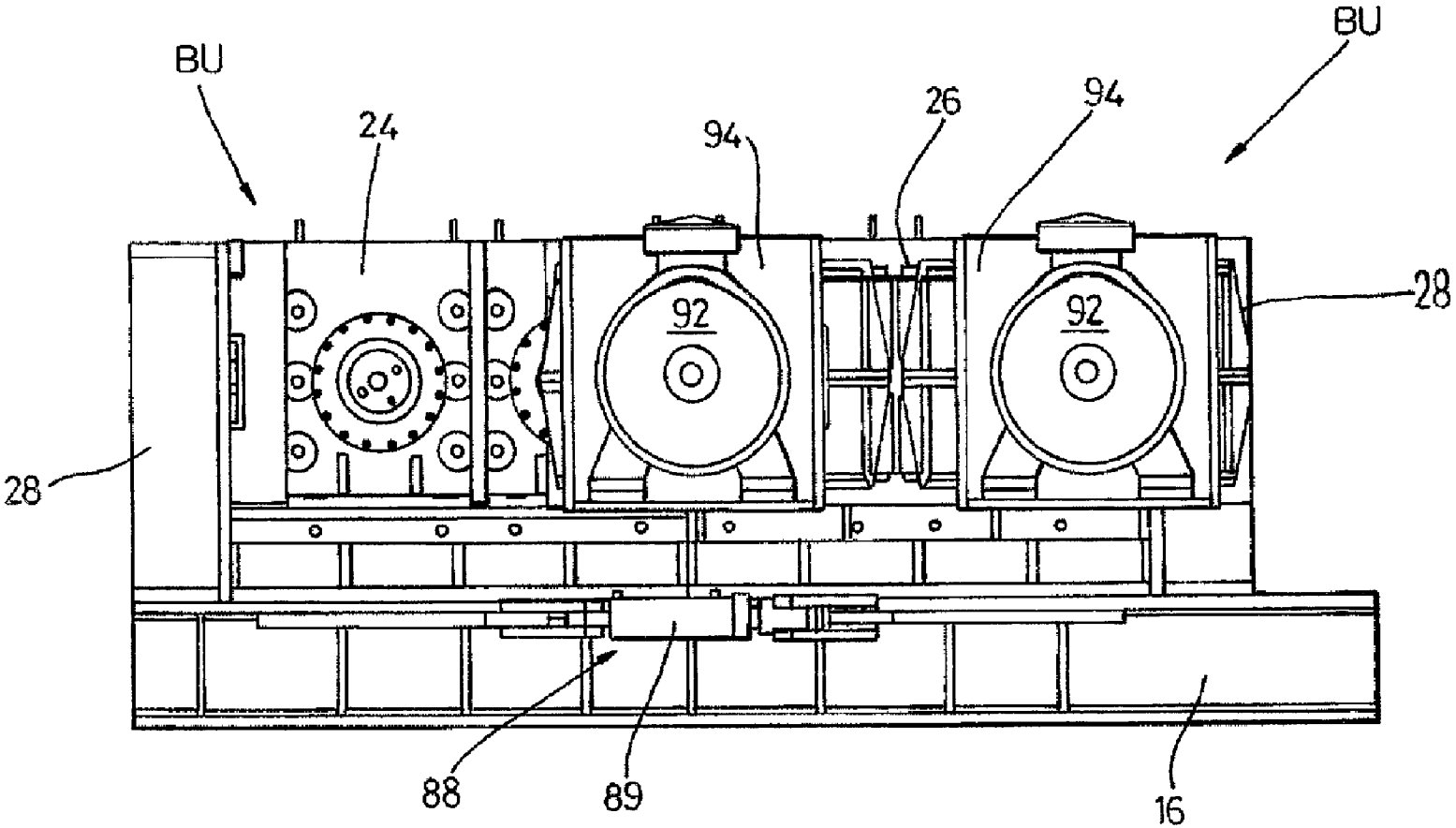
FIG. 3 is an end view of the mineral breaker shown in FIG. 1.

A mineral breaker 10 according to a first embodiment of the present invention is illustrated in FIGS. 1 to 14.

The mineral breaker 10 includes a pair of breaker units BU, which are located side by side on a support frame 12. The support frame 12 is preferably constructed from a pair of opposed front and rear beams 14 (the front beam not being visible) and a pair of opposed side beams 16, 18.

The beams are secured end to end to define a generally rectangular support frame 12. The bottom surface 20 of the support frame 12 would, in use, be seated on the infrastructure of a conveyor unit (not shown). Preferably each beam is fabricated from steel plate.

Each breaker unit BU includes a drum casing 22 having a pair of end walls 24, 26 and a side wall 28.

Preferably, each breaker unit BU includes a pair of side-by-side contra-rotating breaker drum assemblies 30 rotatably mounted in the drum casing 22 so as to extend longitudinally from one end wall 24 to the other end wall 26. Each breaker drum assembly 30 is preferably driven independent by an individual motor 92 via a gear box 94. Preferably, each motor 92 is an electric motor. However, it will be appreciated that other forms of motor, such as a fluid motor, may be used.

Each breaker drum assembly 30 includes a shaft 32, which is rotatably mounted at opposite ends in the respective end walls 24, 26 via bearings. The shaft 32 is preferably of solid section, and is preferably formed from a suitable steel.

Figure 12:
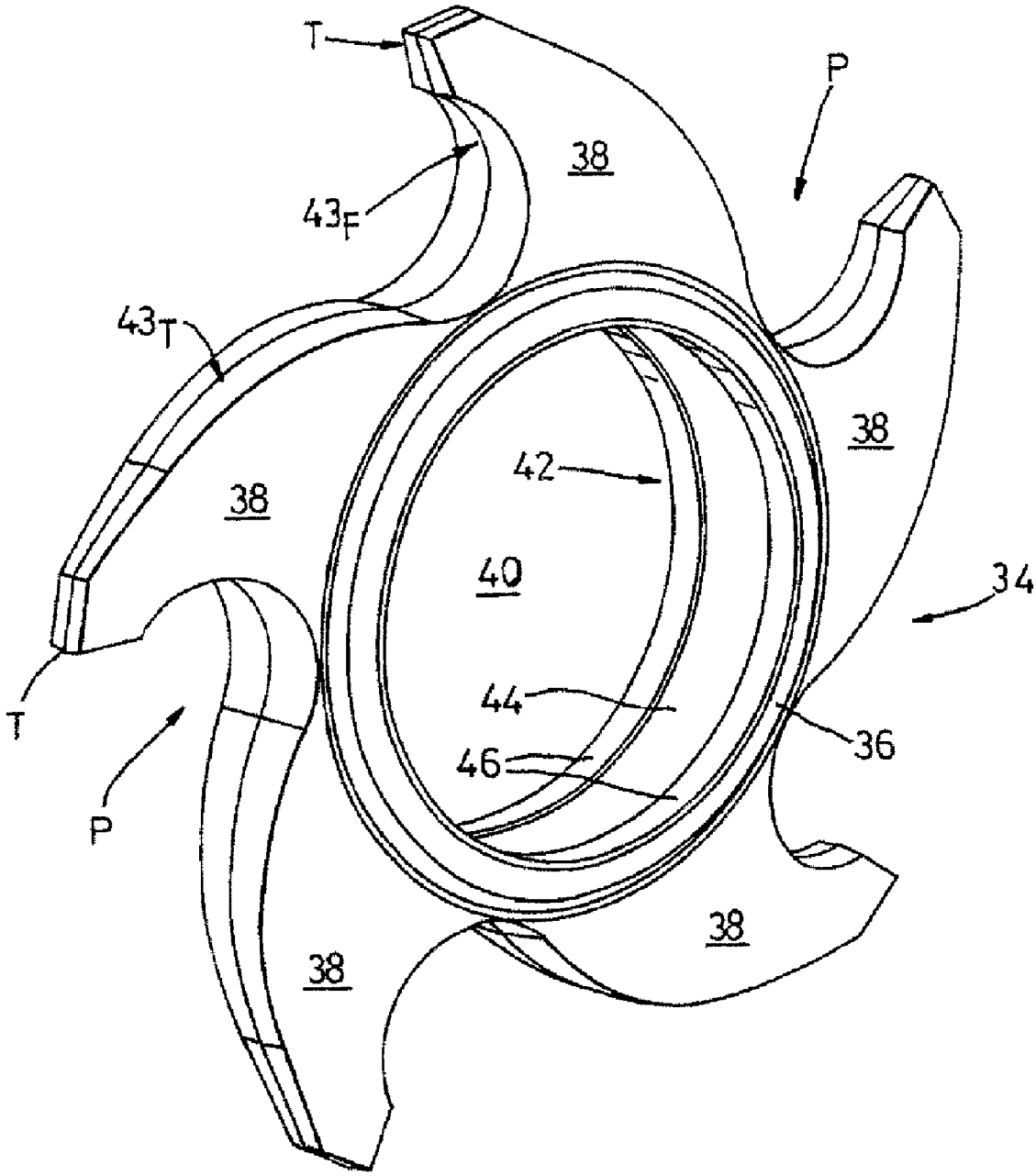
FIG. 12 is a perspective view of a toothed annulus of the breaker unit shown in FIG. 10.

Each breaker drum assembly 30 further includes a plurality of toothed annuli 34 of disc-like form. As shown in FIG. 12, each toothed annulus 34 includes an annular boss 36 from which a plurality of teeth 38 radially project; the teeth 38 per se defining breaker teeth.

Preferably, the annular boss 36 and breaker teeth 38 are formed in one-piece such that the toothed annulus 34 is of a unitary construction with the breaker teeth 38 being integrally connected with the annular boss 36.

Each breaker tooth 38 has a leading face $\mathbf{38}_F$, which extends upwards from the outer circumferential periphery of the annular boss 36 to a tooth tip T, and a trailing face $\mathbf{38}_T$ which extends downwards from the tooth tip T to merge with the leading face $\mathbf{38}_F$ of the succeeding breaker tooth 38. There is thereby defined a series of material accommodating pockets P on each toothed annulus 34, each pocket P being defined between the leading face $38_F$ of one breaker tooth 38 and the trailing face $38_T$ of the preceding breaker tooth 38.

Preferably, each toothed annulus 34 is located on the shaft 32, and is fixedly secured thereto by welding, as will be described below.

One advantage of fixedly securing the toothed annuli 34 to the shaft 32 by welding is the avoidance of keyways both in the toothed annuli 34 and the shaft 32. This avoids localised stress weakness in both the toothed annuli 34 and the shaft 32 that would otherwise be created by the provision of keyways, and also enables the difference in the diameter size of the annular boss 36 and the shaft 32 to be relatively small; in other words, a relatively large diameter shaft 32 can be accommodated in a given diameter size of toothed annulus 34. This has the significant advantage of enabling a relatively large diameter shaft 32 to be used, which thereby enables a relatively large amount of torque or load to be transmitted to the breaker teeth 38.

Figure 5:
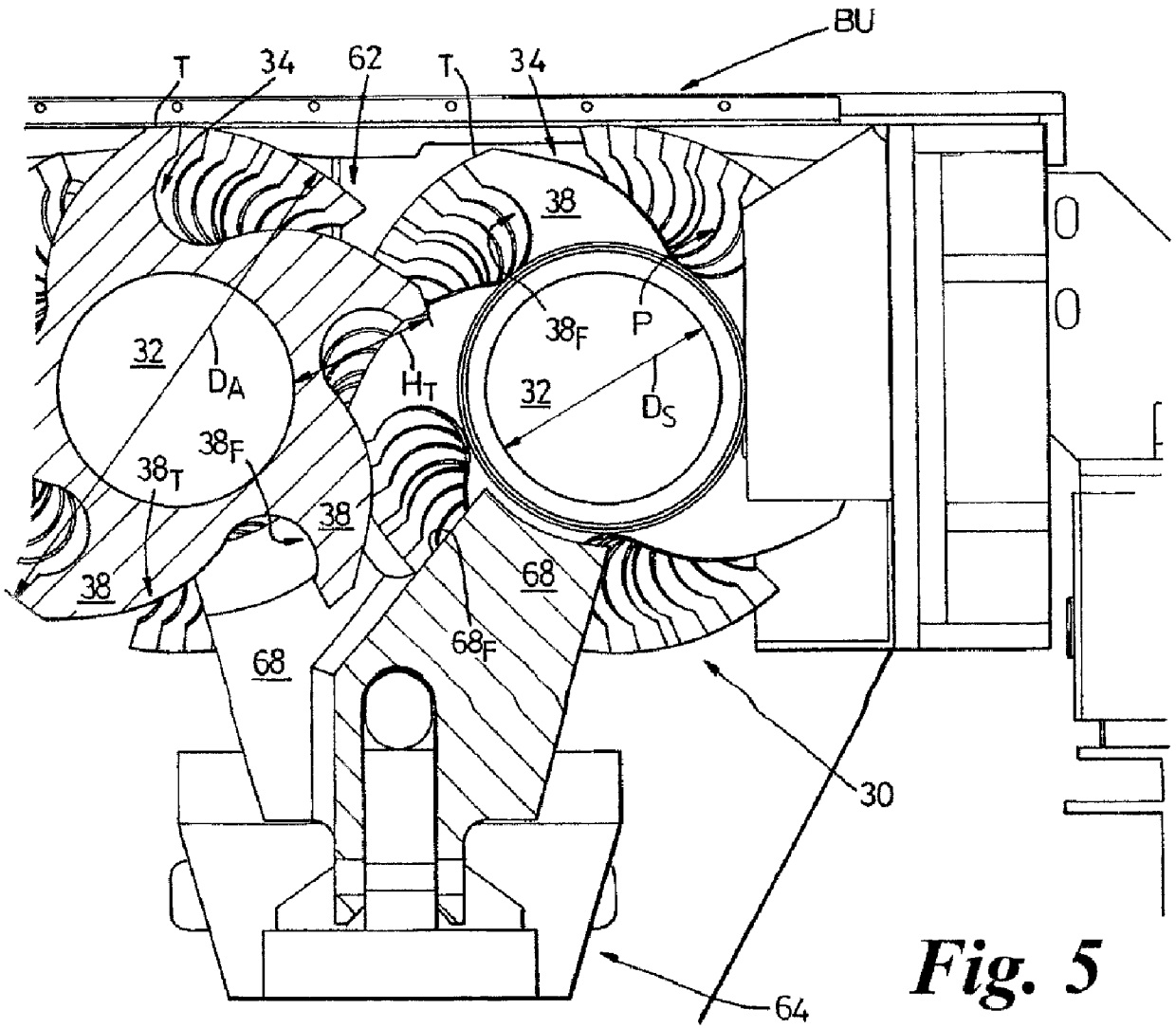
FIG. 5 is a part cross-sectional view taken along the line II-II in FIG. 1.
Figure 6:
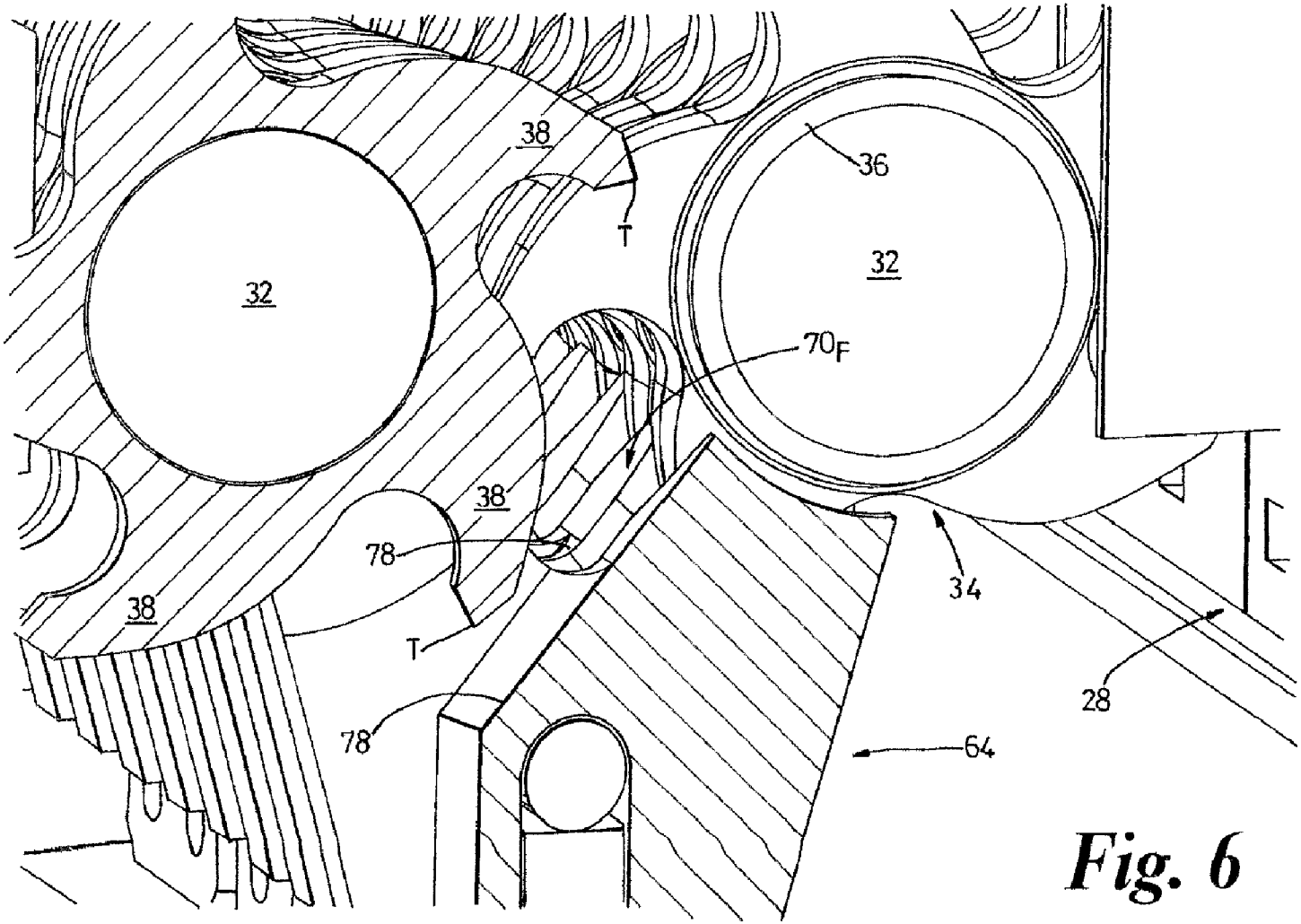
FIG. 6 is a sectional view along the line II-II shown in perspective.

As shown, by way of illustration in FIG. 5, the ratio of the diameter $D_S$ of the shaft 32 relative to the diameter $D_A$ of the toothed annulus 34 is about 1:2.2, and the ratio of the radial height $H_T$ of the tooth tip T of one of the breaker teeth 38 (as measured from the periphery of the shaft 32) to the diameter $D_S$ of the shaft 32 is about 1:1.6.

In other words, the tooth height $H_T$ is greater than the radius of the shaft 32.

In the breaker unit shown in FIGS. 5 to 12, each toothed annulus 34 is a casting or a forging formed from a metal capable of being welded to the shaft 32.

As shown in FIG. 12, all of the breaker teeth 38 are arranged in a single row, which extends circumferentially around the annular boss 36, and are equally spaced about the circumference of the annular boss 36. In the illustrated embodiment, there are five breaker teeth 38 in the row. It is to be appreciated however that the number of breaker teeth 38 in the row may be in the range of 3 to 8 breaker teeth.

To enable the toothed annulus 34 to be received on the shaft 32, the annular boss 36 is provided with a through bore 40. The diameter of the bore 40 is the same as the external diameter of the shaft 32. To enable the toothed annulus 34 to positively seat upon the shaft 32, without rocking (caused by slight differences of size due to tolerances of manufacture), the inner wall 42 of the annular boss 36, which defines the bore 40, is preferably provided with an annular recess 44 to thereby define two axially spaced apart raised annular seats 46 of relatively short axial extent. Accordingly, the toothed annulus 34 seats upon the shaft 32 only via the axially spaced annular seats 46.

As illustrated more clearly in FIG. 12, to fixedly secure the toothed annuli 34 to the shaft 32, adjacent toothed annuli 34 are spaced apart along the length of the shaft 32 such that opposed axial end faces 48, 50 of neighbouring toothed annuli 34 define a gap therebetween with a circumferential portion of the shaft 32 being exposed by the gap. In other words, adjacent toothed annuli 34 are spaced axially apart such that an open topped annular channel is formed therebetween in which the opposed sides of the channel are defined by opposed axial end faces 48, 50, and the bottom of the channel is defined by the exposed circumferential portion of the shaft 32. The channel defines a welding receptor and enables each end face 48, 50 to be welded to the exposed portion of the shaft 32; in practice this means that the channel is filled with weld 52, which is preferably machined to define a smooth solid top face 54 for the channel.

As indicated above, the toothed annuli 34 are of disc-like form (i.e. the axial dimension of each toothed annulus relative to its diameter is small, and the row of breaker teeth on each toothed annulus have substantially planar side faces, which collectively define substantially planar axial side faces of a disc). Accordingly, by arranging the toothed annuli 34 side by side on the shaft 32, a series of annular channels R along the breaker drum assembly 30 are formed, the sides $R_{S1}$, $R_{S2}$ of each channel R being defined by facing axial side faces of each pair of neighbouring toothed annuli 34, and the bottom $R_B$ of the channel R being defined collectively by the outer circumferential face of the annular bosses 36 and top faces 54.

The effective working height h of each breaker tooth 38 is the height of its tip T above the bottom $R_B$ of the neighbouring channel R, and hereinafter the effective working height h of each breaker tooth 38 will be referred to as the "drum height" of the breaker tooth 38.

The drum height h of each breaker tooth 38 is necessarily less than the height $H_T$ due to the intermediate provision of the annular boss 36, which is required for securing the breaker teeth 38 to the shaft 32 (as well as providing a protective covering for the shaft 32). Accordingly, the smaller the radial thickness of the annular boss 36, the greater the possible drum height h of the breaker teeth 38.

As indicated above, welding of the annular boss 36 directed to the shaft 32 enables the radial thickness of the annular boss 36 to be kept to a minimum, and so this capability can be utilized to maximize the drum height h of the breaker teeth 38.

This is advantageous as it enables relatively tall breaker teeth 38 to be provided and so provides the mineral breaker with the capability of gripping large mineral lumps contained in the in-flow mineral.

Preferably, the rotary position of a given toothed annulus 34 relative to its neighbour is off-set by a predetermined increment such that the breaker teeth 38 on the toothed annuli 34 on a given shaft 32 extend along a predetermined helical path in order to define a series of discrete scrolls of breaker teeth, as described in our European patent no. 0 167 178.

In the breaker unit BU shown, the increment by which adjacent toothed annuli 34 are off-set is such that the starting point of each discrete scroll at one end of the breaker drum assembly 30 is off-set from the finishing point of the scroll at the other end of the breaker drum assembly 30 by an angular distance equivalent to two teeth pitch spacings between breaker teeth 38. In the illustrated embodiment, the angular off-set increment between adjacent toothed annuli 34 is 6°.

Figure 13:
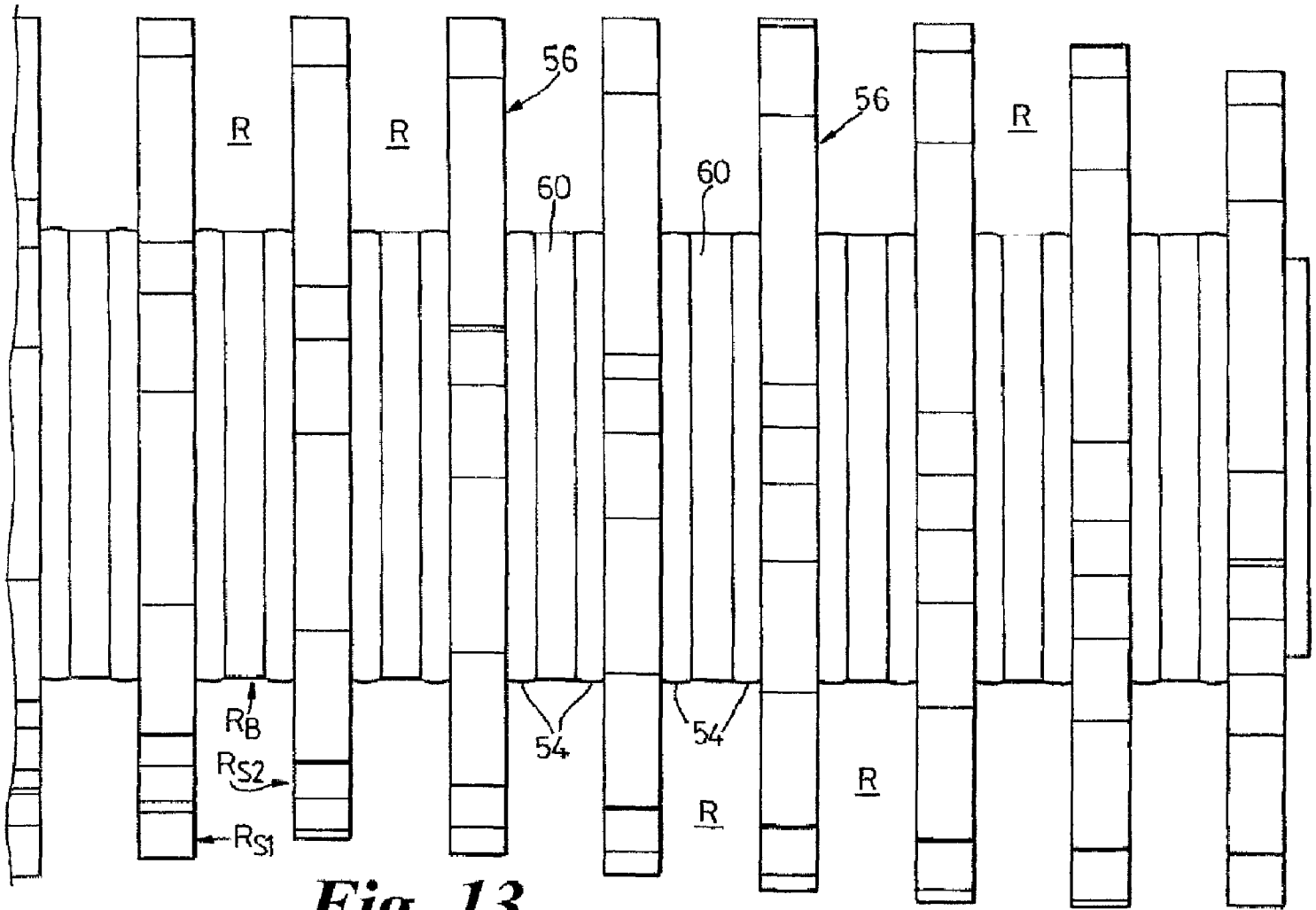
FIG. 13 is a plan view of a breaker drum assembly assembled from toothed annuli according to a further embodiment of the present invention.
Figure 14:
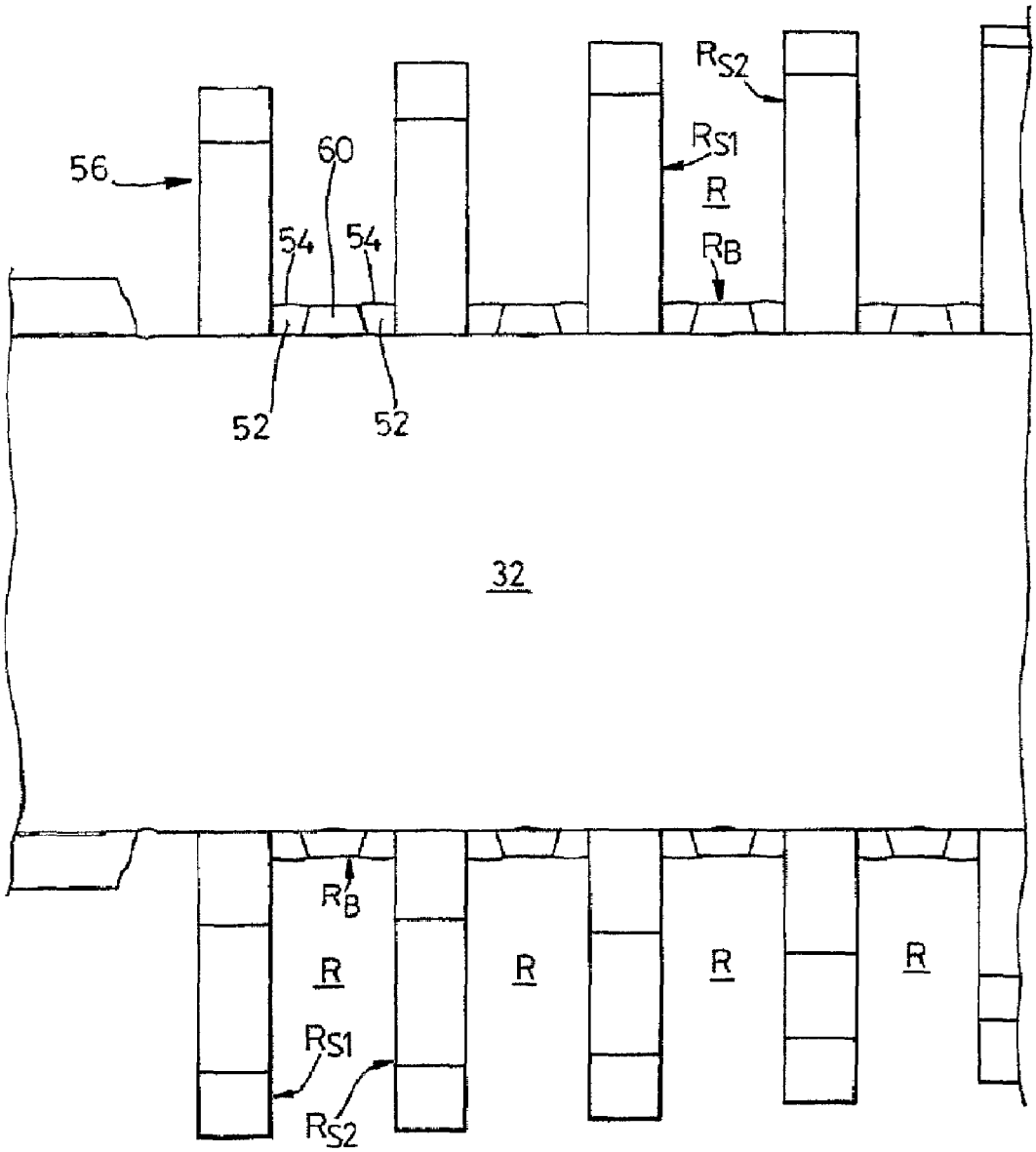
FIG. 14 is an axial section through the breaker drum assembly of FIG. 13.

An alternative toothed annulus 56 is illustrated in FIGS. 13 and 14. Parts similar to those described earlier with reference to FIGS. 5 to 12 have been designated by the same reference numerals.

The toothed annulus 56, instead of being a metal forging or casting, is formed from a suitable metal plate, preferably by profile cutting. Forming the toothed annulus 56 from metal plate has several advantages including ease and consistency of manufacture and improved breaking performance of the breaker teeth derived from the absence of forging/casting faults within the metal grain structure.

The tooth annulus 56 includes a through bore 58 to enable it to be slid onto the shaft 32. Adjacent tooth annuli 56 are spaced apart, preferably by an intermediate spacing ring 60. The intermediate spacing ring 60 is axially spaced from the toothed annuli 56 between which it is located in order to define an open topped annular channel therebetween, which acts as a welding receptor for weld 52. Accordingly toothed annuli 56 are weldingly secured to the shaft 32 in a similar manner to the toothed annuli 34 described with reference to FIGS. 5 to 12.

In FIGS. 13 and 14, the outer circumferential face of the spacing rings 60 and the top face 54 of the weld 52 collectively define the channel bottom $R_B$.

One aim of the breaker unit BU is to break down relatively large lumps of mineral to relatively small lumps of mineral. For example, a breaker unit BU having a distance of 625 mm between the axes of the breaker drum assemblies 30 is expected to be capable of breaking down lumps of about 0.6 $m^3$ down to lumps having a maximum dimension of about 150 mm.

In order for the breaker unit BU to be capable of gripping relatively large lumps of mineral, it is necessary for the drum height h of the breaker teeth relative to the outer diameter of the toothed annulus to be relatively large. This is illustrated diagrammatically in FIG. 9 where the breaker unit includes breaker drum assemblies 30 having axes of rotation separated by a distance of about 625 mm and toothed annuli having an outer diameter of about 780 mm, each breaker tooth having a drum height h of about 175 mm as measured from the outer diameter of the annular boss 36 (which defines the recess bottom $R_B$) and the tip T of the breaker tooth 38.

With such an arrangement, the gap 62 defined between the tips of two opposed breaker teeth 38 is shown as having a width W of about 625 mm and a depth d of about 160 mm (the depth d being defined as the height of the tip of a breaker tooth above the bottom of the gap 62, as defined by the trailing faces $\mathbf{38}_T$ of the preceding breaker tooth 38). In other words, gap 62 enables relatively large lumps of mineral to be grippingly received between opposed breaker teeth 38 to permit a primary breaking action to be performed on the mineral lump, in accordance with the principles of breaking discussed in our European patent no. 0 167 178.

In the above example, the ratio of the drum height h of a breaker tooth 38 relative to the radius of the toothed annulus 34, 56 is approximately 1:2.2.

It is envisaged however that the ratio of the drum height h of a breaker tooth 38 relative to the radius of the toothed annulus 34, 56 may be varied in order to achieve different sizes of gap 62.

In this respect, it is expected that this ratio will be in the range of about 1:2.5 to 1:1.5.

In order to achieve a relatively small size of broken lump emerging from the breaker unit BU, it is necessary for the axial dimension of channel R between adjacent tooth annuli 34, 56 to be relatively small, which also requires the width $w_t$ of the breaker teeth 38 to be relatively small and preferably be of a width dimension which is less than a maximum dimension of the desired broken lumps to be achieved.

Figure 9:
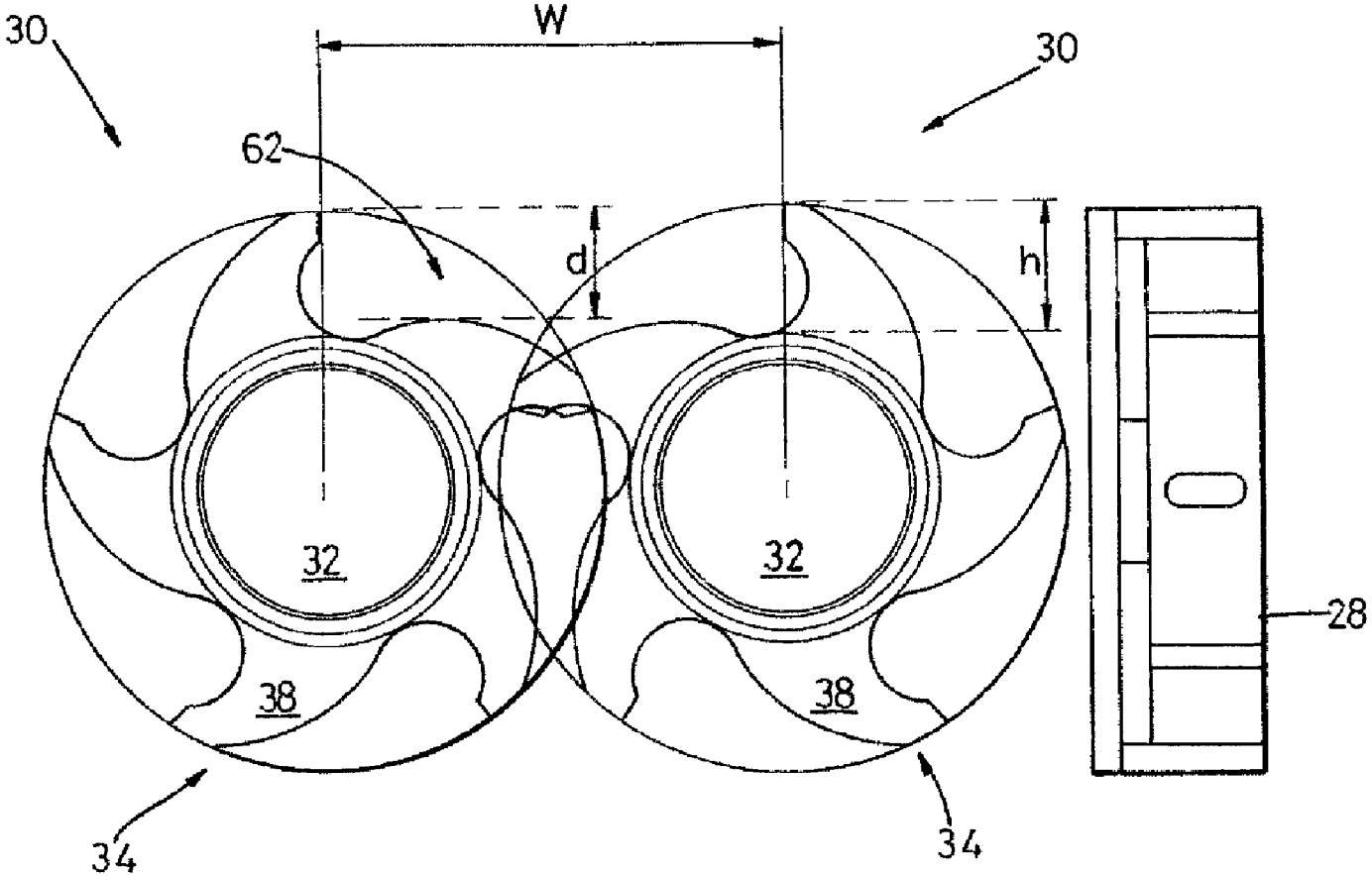
FIG. 9 is a schematic end view illustrating the relative rotational positions of a pair of opposed toothed annuli.
Figure 10:
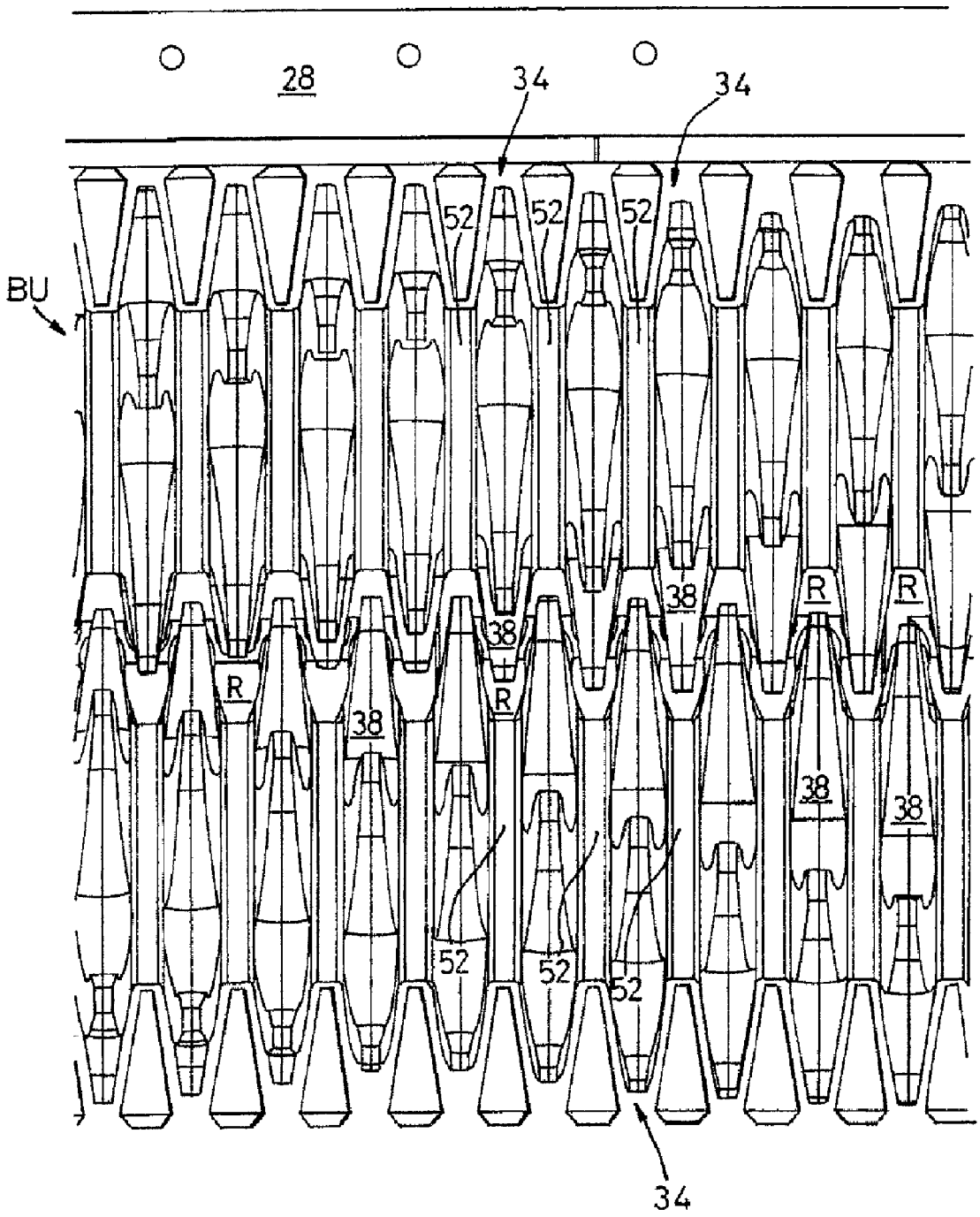
FIG. 10 is a part plan view of a breaker unit of the mineral breaker shown in FIG. 1.
Figure 11:
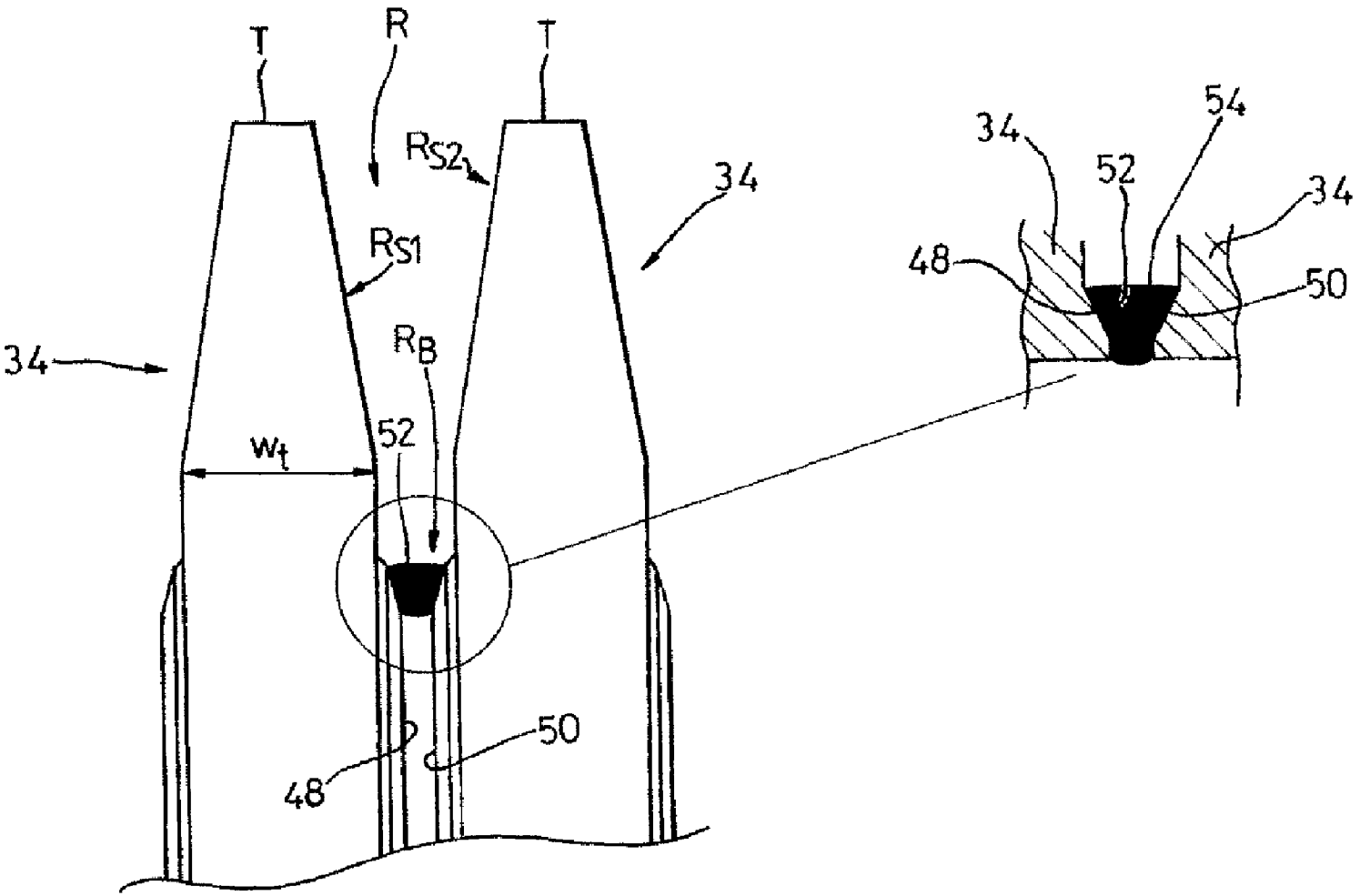
FIG. 11 is an axial section through a pair of adjacent toothed annuli mounted on a shaft.

In the breaker unit BU illustrated in FIG. 9, the maximum width $w_t$ of each breaker tooth 38 at its base is chosen to be about 85 mm, with the breaker tooth 38 tapering to its tip T, which has a width of approximately 27 mm. In the embodiment of FIG. 10, the plate thickness from which the toothed annuli 56 are cut is about 70 mm.

With such an arrangement, each breaker tooth 38 on one breaker drum assembly 30 acts to break lumps down by a snapping action by forcing mineral lumps downwardly through the channel R defined between two adjacent breaker teeth 38 on the opposed breaker drum assembly 30.

As seen in FIG. 10, the dimensions of each channel R in the longitudinal direction of the breaker drum assemblies 30 will determine the maximum size dimension of the broken lump in the longitudinal direction of the breaker unit BU.

Preferably, the relative cross-sectional size and shape of each breaker tooth 38 and the channel R through which it sweeps during rotation of the breaker drum assemblies 30 are such that at least the leading and trailing faces $\mathbf{38}_F$, $\mathbf{38}_T$ (and preferably the side faces of each breaker tooth 38) are closely spaced with the side of the channel R. This helps to ensure that material passing between the breaker drum assemblies 30 predominantly has to be passed through the pockets P in-between adjacent breaker teeth 38 on a given toothed annulus 34, 56 rather than being allowed to pass through gaps between a toothed annulus and the sides/bottom of a channel R in which it is located.

With the above arrangement, it will be appreciated that a mineral lump seated in the pocket P between two adjacent breaker teeth 38 on the same toothed annulus 34, 56 may have a dimension in excess of the desired maximum lump dimension in the direction of rotation of the toothed annulus 34, 56 after a breaker tooth 38 has forced the lump through the channel R on the opposed breaker drum assembly 30.

In order to ensure that such a lump is broken down further, the breaker unit BU preferably includes a breaker bar assembly 64 located beneath the breaker drum assemblies 30. The provision of the breaker bar assembly 64 also ensures that long thin lumps of mineral, extending longitudinally of the breaker drum assemblies 30, cannot pass through without being broken down.

Figure 7:
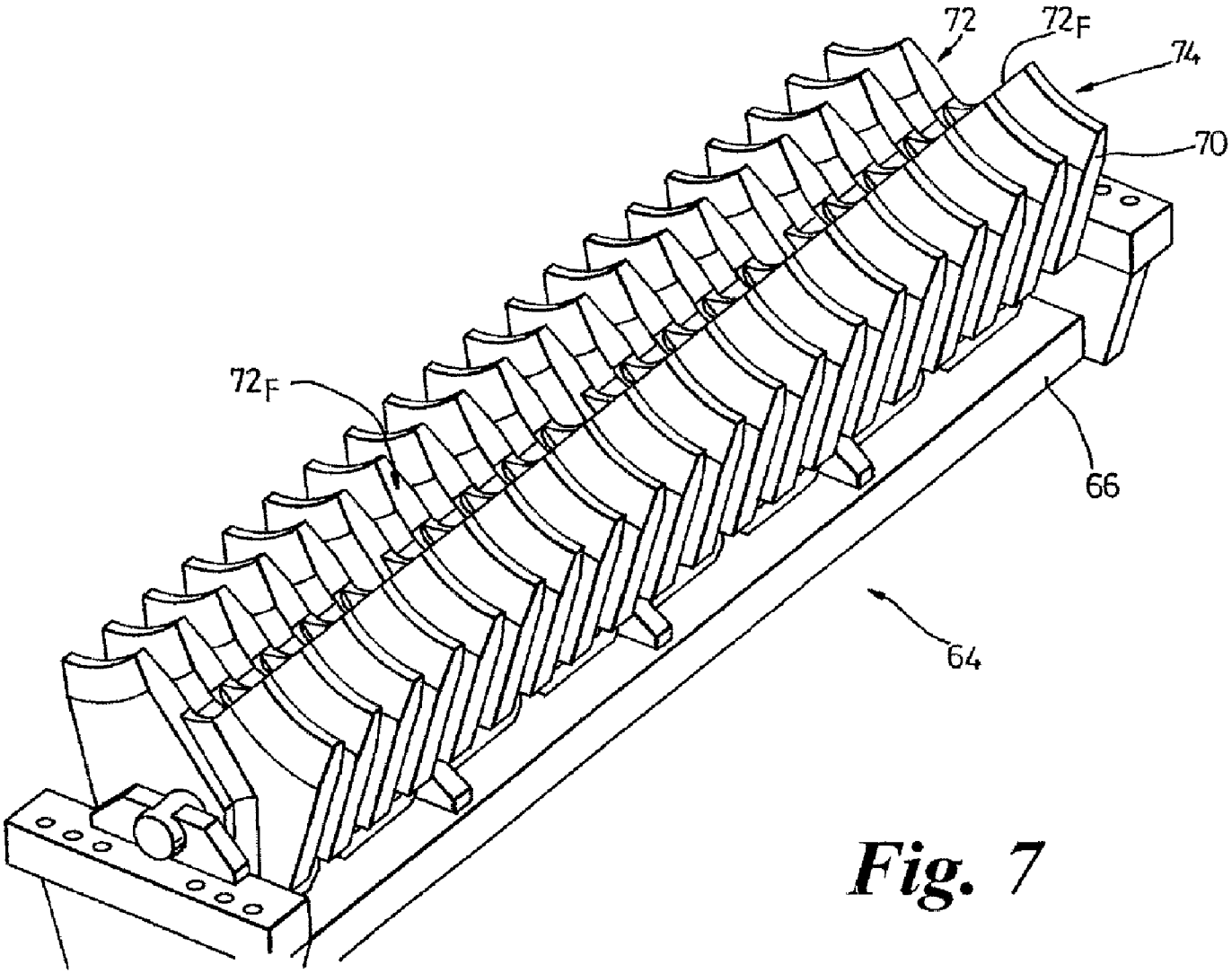
FIG. 7 is a perspective view from above of a breaker bar assembly.
Figure 8:
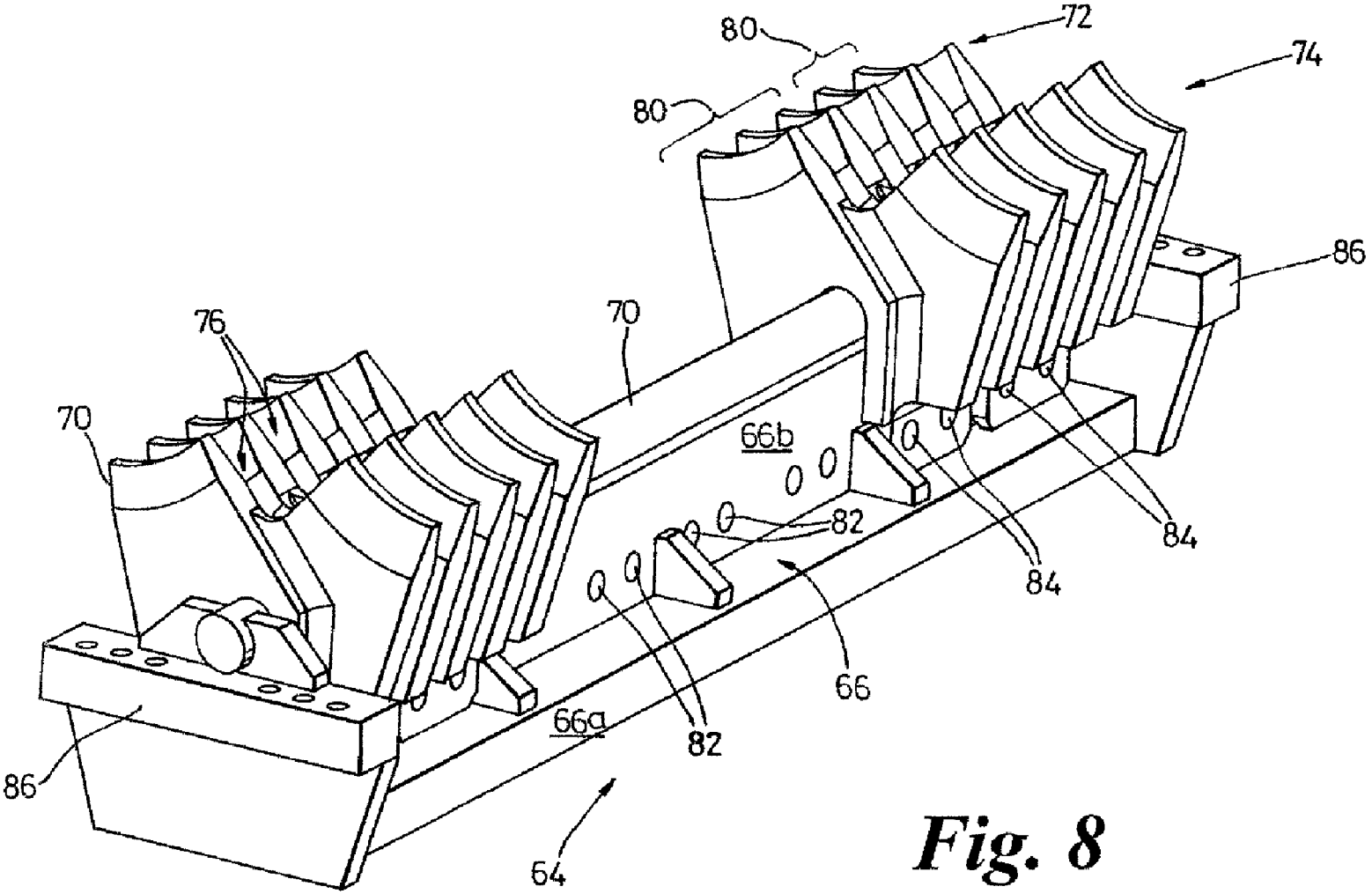
FIG. 8 is a view similar to FIG. 7 showing the breaker teeth removed.

The breaker bar assembly 64 illustrated in FIGS. 7 and 8 is elongate and extends longitudinally in a direction parallel to, and centrally located between the axes of rotation of the drum assemblies.

The breaker bar assembly 64 includes a main elongate support body 66, which is secured at each end to a respective end wall 24, 26 of the drum casing 22. The breaker bar assembly 64 thereby preferably serves as a strengthening beam extending in-between, and connecting, the opposed end walls 24, 26.

The support body 66 is of generally "T" shaped cross-section, having a horizontal part 66*a* and a vertical part 66*b*. Preferably, a strengthening bar 68 extends along the upper edge of the vertical part 66*b*.

The support body 66 has mounted thereon a plurality of breaker teeth 70.

The breaker teeth 70 are each of blade-like form, and project upwardly into the annular recess R defined between adjacent toothed annuli 34, 56 on one breaker drum assembly 30.

The cross-sectional shape and size of each breaker tooth 70 is similar to that of channel R so that each breaker tooth 70, in cross-section, substantially fills channel R. This has the effect of enabling the leading face 70F of breaker teeth 70 to act as scrapers to clear material adhering between adjacent toothed annuli 34, 56; this is particularly useful when handling sticky materials such as clays or tar sand.

In addition, since each breaker tooth 70 substantially fills each channel R, the breaker teeth 70 on the breaker bar assembly 64 act to choke the flow of mineral emerging from between the breaker drum assemblies 30. This has the effect of agitating mineral emerging from between the breaker drum assemblies 30, and so assist in dislodging any oversized lumps located in-between adjacent breaker teeth 38 on the same toothed annulus 34, 56. These oversized lumps are then broken down further by interaction between the breaker teeth 38 and the adjacent breaker teeth 70 between which it passes.

As seen in FIGS. 7 and 8, the breaker teeth 70 are arranged in two longitudinally extending rows 72,74 wherein the breaker teeth 70 in one row 72 co-operate with one breaker drum assembly 30 and the breaker teeth 70 in the other row 74 cooperate with the other breaker drum assembly 30.

Breaker teeth 70 in a given row are spaced apart in the longitudinal direction of the support body 66 to define a groove or recess 76 through which the breaker teeth 38 on an associated toothed annulus 34, 56 pass during rotation of the breaker drum assembly 30.

The groove 76 has sides defined by a side edge of an intermediate breaker tooth 70 on one row and a bottom 78 defined by a side edge of an intermediate breaker tooth 70 from the other row.

The bottom 78 at the mouth entrance to groove 76 is preferably closely spaced from the tip T of breaker teeth 38 passing into groove 76 so as to reduce the available pocket size in which an oversized lump may be accommodated between the leading face $\mathbf{38}_F$ of one breaker tooth 38 and the trailing face $\mathbf{38}_T$ of an adjacent breaker tooth 38 on the same toothed annulus 34, 56.

Preferably the breaker teeth 70 are formed in blocks of teeth 80, which straddle the vertical part 66*b* of the support body 66, and are secured thereto by through bolts (not shown) passing through bores 82 formed in the vertical part 66*b* and bores 84 formed in blocks 80. Preferably, the blocks 80 are each cast from a suitable metal and each comprise a number of breaker teeth 70 for forming one row 72 and a number of breaker teeth 70 for forming the other row 74. Conveniently, the number of breaker teeth 70 in each block 80 is five with three breaker teeth 70 on one side and two breaker teeth 70 on the other side. Thus, by mounting adjacent blocks 80 on the vertical part 66*b* with alternate blocks 80 having three breaker teeth 70 on one side of the vertical part 66*b* and two breaker teeth 70 on the other side of vertical part 66*b*, it is possible to create the two rows 72, 74 of breaker teeth 70.

The support body 66 is preferably provided with mounting flanges 86 at each end via which the breaker bar assembly 64 may be mounted on the opposed end walls 24, 26 of the drum casing 22.

It is envisaged that the height of the breaker bar assembly 64 relative to the breaker drum assemblies 30 may be adjusted by the placement of shims beneath flanges 86. This enables the terminal edges 70*a* of the breaker teeth 70 to be closely spaced relative to the bottom of the recess R, and also enables the bottom 78 at the mouth entrance to grooves 76 to be closed spaced relative to the tips T of the breaker teeth 38.

In other embodiments, the breaker bar assembly may be of the construction described in our PCT patent application no. PCT/GB2004/001652.

In the breaker unit BU described with reference to FIGS. 2 to 14, the teeth 38 per se of each toothed annulus 34, 56 define a breaker tooth. It is envisaged that the teeth 38 may instead define the core or horn to which a tooth cap or wear plate may be attached to define the breaker tooth. Examples of breaker teeth having a core or horn, and a covering cap, are described in our European patent no. 0 167 178.

Figure 4:
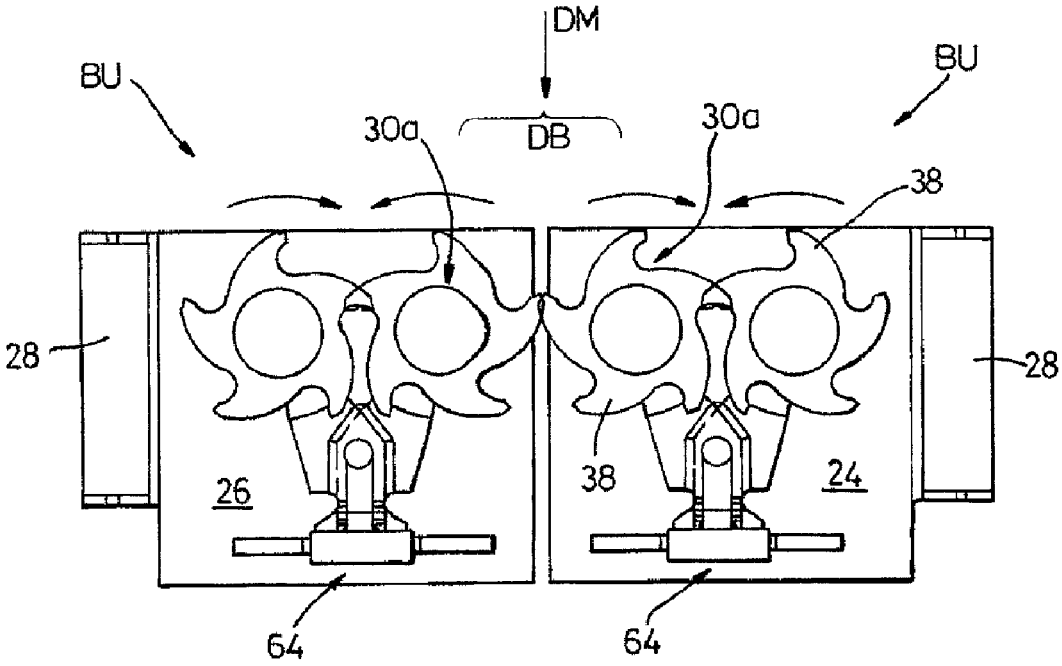
FIG. 4 is a cross-sectional view taken along the line IV-IV in FIG. 2.

As shown in FIG. 4, the contra-rotating break drum assemblies 30 of each breaker unit BU rotate so as to direct mineral inwardly of the breaker unit BU, that is towards the opposing breaker drum assembly 30. This means that oversized mineral is gripped between the opposing breaker drum assemblies 30 and broken down; the broken down mineral being forced by the rotating breaker drum assemblies 30 downwardly in-between the breaker drum assemblies 30 for further breakage, if required, with the associated breaker bar assembly 64.

The breaker units BU are located side-by-side on the support frame 12 such that the open side of their respective casings 22 (i.e. the open side opposite to side wall 28) are located adjacent to one another.

This arrangement of the breaker units BU results in the breaker drum assemblies 30*a* of each breaker unit BU being located side-by-side, adjacent to one another, to form an inner pair DB of contra-rotating breaker drum assemblies 30.

As seen more clearly in FIG. 4, the contra-rotating breaker drum assemblies 30*a* of the inner pair DB rotate such that mineral located in-between the drum assemblies 30*a* is directed outwardly toward the other breaker drum assembly 30 of each breaker unit BU.

The breaker drum assemblies 30*a* of the inner pair DB are laterally spaced from one another such that the toothed annuli 34, 56 of one breaker drum assembly 30*a* are axially off-set with the toothed annuli 34, 56 of the other breaker drum assembly 30*a*, with the breaker teeth 38 on each toothed annuli 34, 56 of one breaker drum assembly 30*a* passing into the axial gap in-between a pair of adjacent toothed annuli 34, 56 of the other breaker drum assembly 30*a*. As indicated schematically by arrow DM in FIG. 4, this region in-between the breaker drum assemblies 30*a* of the inner pair DB is the area into which mineral to be processed is deposited; this area being defined by the inter-leafing of the toothed annuli 34, 56 of the breaker drum assemblies 30*a*.

The inter-leafing of the toothed annuli 34, 56 in region DM acts to prevent oversized lumps to pass therebetween. As viewed in FIG. 4, it will be seen that the inter-leafing also appears to substantially close off the passageway in-between the breaker drum assemblies 30*a* of the inner pair DB, and so potentially restrict passage of undersized lumps and fines therethrough.

However, since the breaker teeth 38 on the contra-rotating breaker drum assemblies 30*a* of the inner pair DB, in the region in-between the breaker drum assemblies 30*a*, are moving in an upwards direction, in opposition to the direction of flow of the mineral being deposited into region DM, the teeth 38 act to agitate and, in effect, fluff up the deposited mineral. Accordingly, this action encourages undersized mineral to fall downwardly through the space between the breaker drum assemblies 30*a* of the inner pair DB.

This action also acts to remove a high proportion of the undersized mineral such that the proportion of undersized mineral being carried over with the oversized mineral, for passage between the pair of breaker drum assemblies 30 of each breaker unit BU is reduced. Accordingly, since the undersized mineral can form a large proportion of the volume of the inflow mineral being deposited in region DM, it means that the mineral breaker 10 can handle a relatively large throughput of mineral.

Preferably, the distance between the breaker drum assemblies 30*a* of the inner pair DB is adjustable such that the size of the effective passageway therebetween for the flow of undersized mineral can be varied.

Preferably, this adjustment of the distance between the breaker drum assemblies 30*a* of the inner pair DB is achieved by fixedly mounting one breaker unit BU on the support frame 12, slidably mounting the other breaker unit BU on the support frame 12 and providing motive means 88, such as a pair of hydraulic rams 89 for causing relative movement between the breaker units BU.

Figure 15:
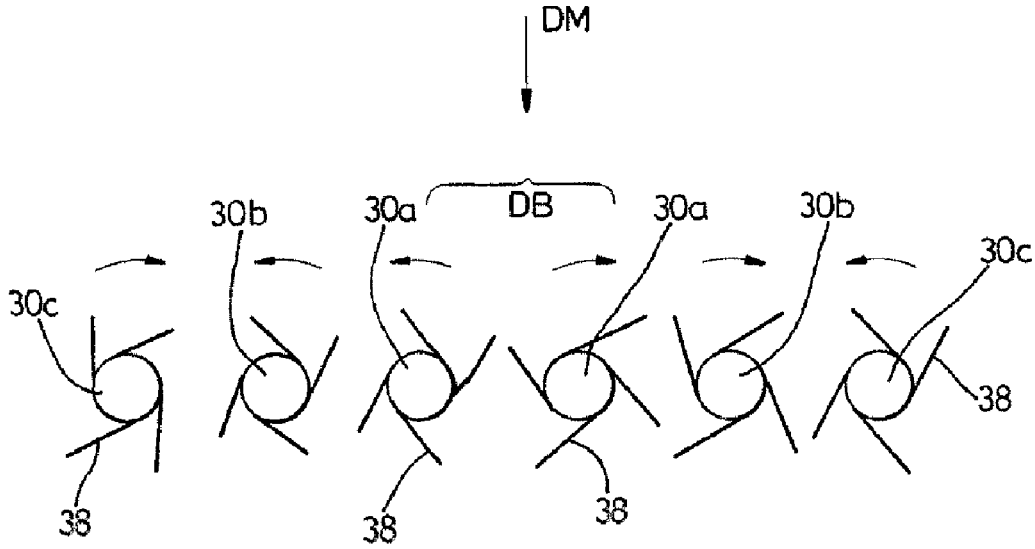
FIG. 15 is a cross-sectional view similar to FIG. 4 of a mineral breaker according to a yet further embodiment of the present invention.

As schematically illustrated in FIG. 15, the mineral breaker 10 described with reference to FIGS. 1-14 may be modified by the inclusion of additional breaker drum assemblies 90 to define a row of breaker drum assemblies exceeding four breaker drum assemblies 90.

In the embodiment of FIG. 15, the breaker drum assemblies 90*b*, immediately adjacent to the inner pair of breaker drum assemblies 90*a*, are arranged to rotate in the same direction as its neighbouring inner breaker drum assembly 90*a*.

Accordingly, a given inner breaker drum assembly 90*a* acts to feed oversized mineral to its adjacent breaker drum assembly 90*b*, which in turn feeds the oversized mineral to the outer breaker drum assembly 90*c*.

The outer breaker drum assembly 90*c* is arranged to rotate in the opposite direction as its neighbouring breaker drum assembly 90*b* and the breaker teeth 38 on the breaker drum assemblies 90*b*, 90*c* co-operate to break down some of the oversized mineral. The broken down undersized mineral is able to fall in-between the breaker drum assemblies 90*b*, 90*c*.

In addition, the space between each of the inner breaker drum assemblies 90*a* and its neighbouring breaker drum assembly 90*b* provides a further opportunity for any undersized mineral fed by the inner breaker drum assembly 90*a* from region DM to fall away before reaching the outer breaker drum assembly 90*c*.

What is claimed is:

1. A mineral breaker including a row of side-by-side breaker drum assemblies having radially projecting breaker teeth, the row including at least four breaker drum assemblies arranged to define an inner pair of adjacent breaker drum assemblies located in-between a pair of outer breaker drum assemblies, said inner pair of breaker drum assemblies defining therebetween a mineral deposit region for receiving mineral in-flow, the breaker drum assemblies of said inner pair of breaker drum assemblies being rotated in opposite directions outwardly such that, in use, breaker teeth on each of said inner breaker drum assemblies act upon mineral being deposited in said deposit region to cause agitation of the deposited mineral in-flow in order to encourage undersized mineral to pass therebetween whilst preventing oversized mineral passing therebetween, and each breaker drum assembly of said inner pair of breaker drum assemblies acting upon oversized mineral in the material in-flow to cause the oversized mineral to be moved outwardly towards a respective one of said outer breaker drum assemblies, and each breaker drum assembly of said inner pair of breaker drum assemblies forming with said respective one of said outer breaker drum assemblies a pair of breaker drum assemblies being rotated in opposite directions inwardly so as to direct material downwardly in-between the said breaker drum assemblies.

2. A mineral breaker according to claim 1 wherein the distance in-between the breaker drum assemblies of said inner pair of breaker drum assemblies is adjustable.

3. A mineral breaker according to claim 1 wherein said row of breaker drum assemblies is defined by four side-by-side breaker drum assemblies, each breaker drum assembly in said row being arranged to rotate in an opposite direction to its adjacent breaker drum assembly.

4. A mineral breaker according to claim 3 wherein a first pair of breaker drum assemblies are rotatably mounted in a first drum casing to define a first breaker unit and a second pair of breaker drum assemblies are rotatably mounted in a second drum casing to define a second breaker unit, the first and second breaker units being positioned side-by-side.

5. A mineral breaker according to claim 4 wherein said first and second drum casings are mounted on a common support frame, at least one of said drum casings being slidably movable on said support frame to enable the distance between the breaker units to be adjusted.

6. A mineral breaker according to claim 1 wherein one or more feed breaker drum assemblies are located in-between an inner breaker drum assembly and its adjacent outer breaker drum assembly, each of said feed breaker drum assemblies being arranged to rotate in the same direction as said inner breaker drum assembly.

7. A mineral breaker according to claim 2 wherein one or more feed breaker drum assemblies are located in-between an inner breaker drum assembly and its adjacent outer breaker drum assembly, each of said feed breaker drum assemblies being arranged to rotate in the same direction as said inner breaker drum assembly.

* * * * *